US006726129B2

(12) United States Patent
Kao

(10) Patent No.: US 6,726,129 B2
(45) Date of Patent: Apr. 27, 2004

(54) ORIENTATION ADJUSTABLE SPRAYING NOZZLE

(76) Inventor: Wen Li Kao, 235 Chung-Ho Box 8-24, Taipei (TW)

( * ) Notice: Subject to any disclaimer, the term of this patent is extended or adjusted under 35 U.S.C. 154(b) by 0 days.

(21) Appl. No.: 10/421,039

(22) Filed: Apr. 24, 2003

(65) Prior Publication Data

US 2003/0201348 A1 Oct. 30, 2003

(30) Foreign Application Priority Data

Apr. 29, 2002 (TW) ..... 91206088 U

(51) Int. Cl.[7] ..... B05B 15/08
(52) U.S. Cl. ..... 239/587.1; 239/526; 239/532
(58) Field of Search ..... 239/525, 526, 239/530, 532, 587.1, 587.3, 587.4, 587.5, 587.6; 285/184, 185, 272, 276, 277, 282

(56) References Cited

U.S. PATENT DOCUMENTS 6,508,415 B2 * 1/2003 Wang ..... 239/526
6,511,001 B1 * 1/2003 Huang ..... 239/526
6,592,057 B1 * 7/2003 Ericksen et al. ..... 239/587.1
6,609,847 B1 * 8/2003 Wang ..... 401/137

* cited by examiner

*Primary Examiner*—Michael Mar
*Assistant Examiner*—Thach H Bui

(57) ABSTRACT

A spray nozzle has a main rod extended from a handle. The main rod is formed with a locking hole. A fixing hole is formed aside the locking hole. A spring and a rolling ball are pre-mounted in the fixing hole. A second half dome shape joint of a nozzle is protruded with an annular locking seat. A periphery of the annular locking seat is formed with an annular recess which is exactly communicated to the water inlet of the nozzle. A center of the annular locking seat is formed with a pivotal hole which is coupled to the locking hole of the main rod. The annular locking seat of the nozzle has a plurality of limiting holes; thereby, the rolling balls in the fixing hole of the main rod being confined in the limiting holes. The orientation of the nozzle is adjustable with respect to the main rod.

1 Claim, 4 Drawing Sheets

ORIENTATION ADJUSTABLE SPRAYING NOZZLE

FIELD OF THE INVENTION

The present invention relates to nozzles, and particularly to a spraying nozzle in that the orientation of the nozzle is adjustable with respect to a main rod so that the user can operate the nozzle easily.

BACKGROUND OF THE INVENTION

A prior art spraying nozzle includes a handle, a main rod extended to an upper side of the handle, and a nozzle, wherein the main rod is directly connected to the nozzle. In use, the nozzle cannot rotate with respect to the main rod. Thereby, the user cannot spray the water easily and conveniently. Many places cannot be sprayed with a pose to be comfortable to the user. Thereby, the operation is inconvenient.

SUMMARY OF THE INVENTION

Accordingly, the primary object of the present invention is to provide a spraying nozzle, in that the orientation of the nozzle is adjustable with respect to a main rod so that the user can operate the nozzle easily.

To achieve above objects, the present invention provides a spray nozzle. A main rod is extended to an upper side of a handle. A first half dome shape joint at a front end of the main rod has a groove communicated to the water outlet of the main rod. A center of the groove is formed with a locking hole. A fixing hole is formed aside the locking hole. A spring and a rolling ball are pre-mounted in the fixing hole. A nozzle is locked to the locking hole of the main rod by a stud. A second half dome shape joint of the nozzle is protruded with an annular locking seat. A periphery of the annular locking seat is formed with an annular recess which is exactly communicated to the water inlet of the nozzle. A center of the annular locking seat being formed with a pivotal hole which is coupled to the locking hole of the main rod. The annular locking seat of the nozzle has a plurality of limiting holes; thereby, the rolling balls in the fixing hole of the main rod being confined in the limiting holes. The orientation of the nozzle is adjustable with respect to the main rod.

The various objects and advantages of the present invention will be more readily understood from the following, detailed description when read in conjunction with the appended drawing.

DETAILED DESCRIPTION OF THE PREFERRED EMBODIMENTS

Figure 1:
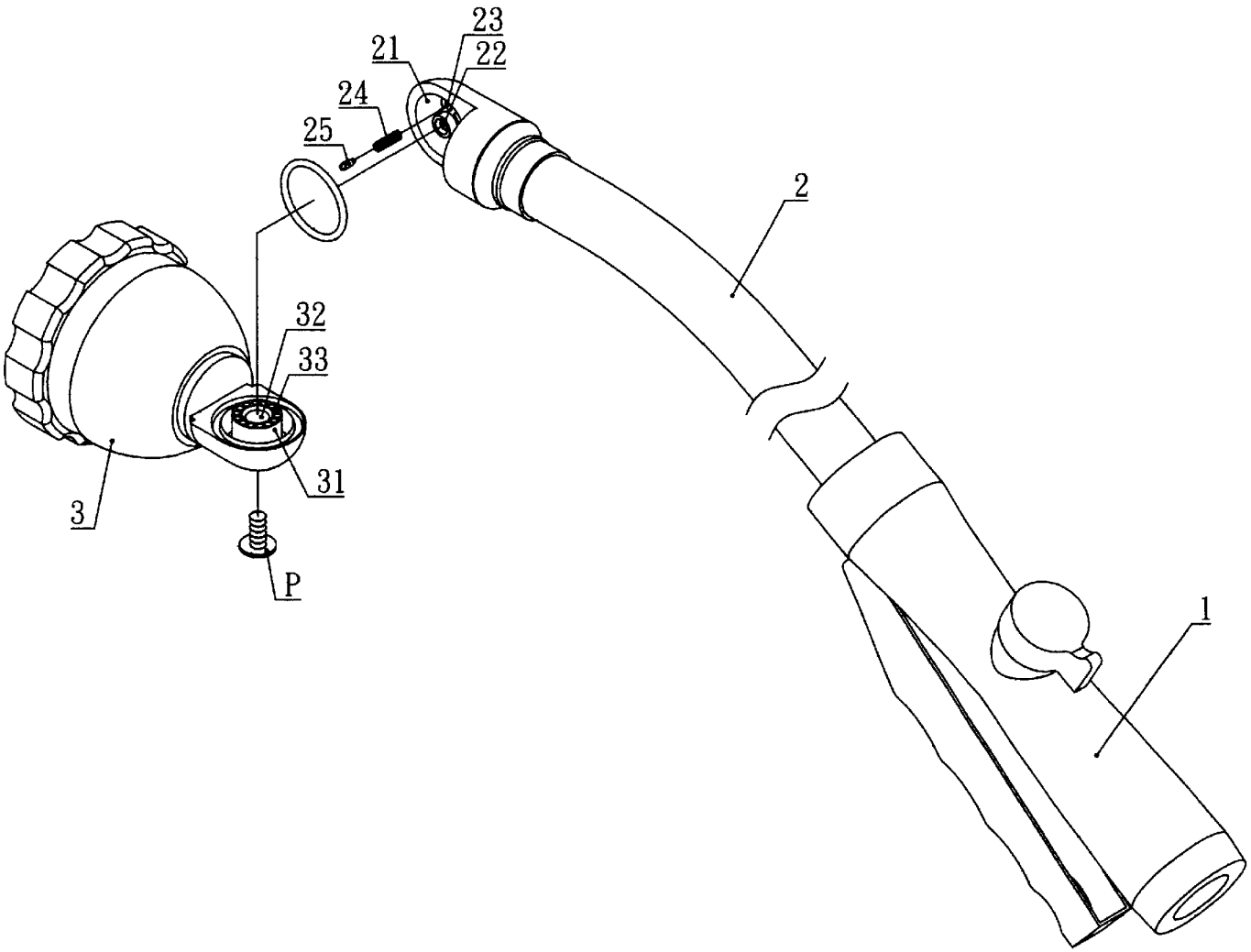
FIG. 1 is an exploded perspective view of the spraying nozzle of the present invention.
Figure 2:
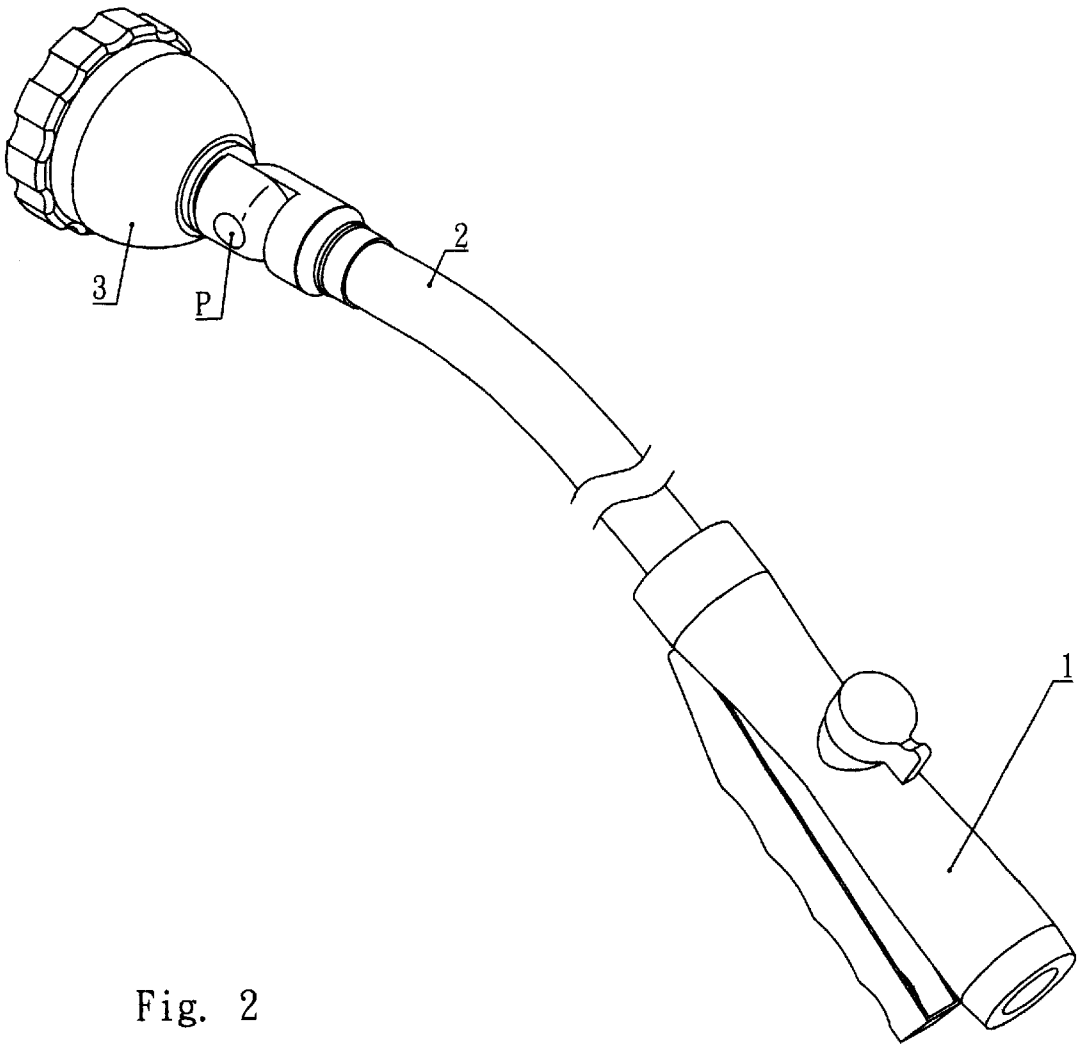
FIG. 2 is an assembled perspective view of the spraying nozzle of the present invention.
Figure 3:
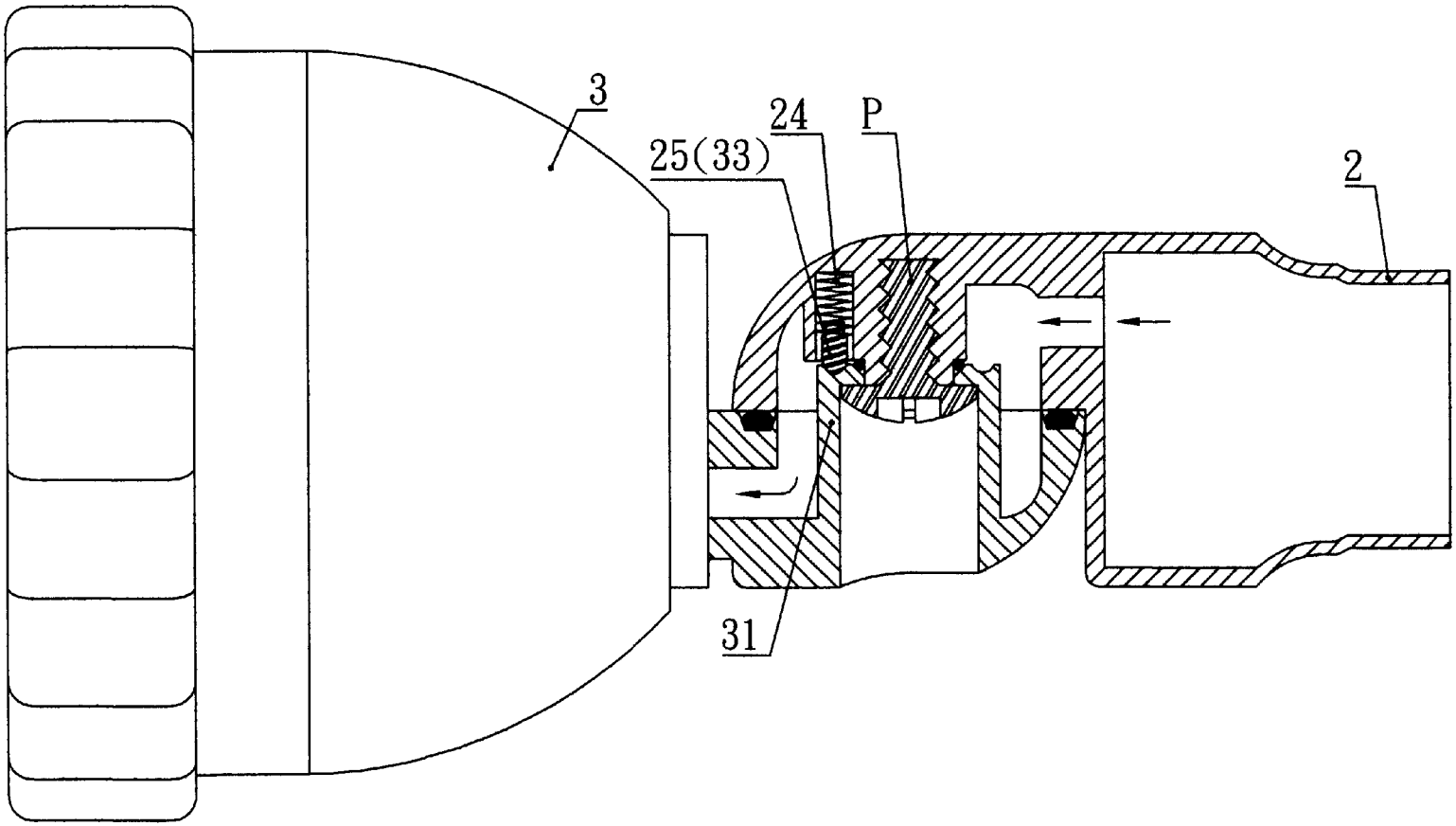
FIG. 3 is a front view showing the assembly of the, present invention.

Referring to FIGS. 2 and 3, the structure of the present invention is illustrated. The spray nozzle of the present invention has a handle 1, a main rod 2 extended to the upper side of the handle 1, and a nozzle 3. A portion of the main rod 2 connecting to the nozzle 3 has a first half dome shape joint 2A and a second half dome shape joint 2A.

A first half dome shape joint 2A at the front end of the main rod 2 having a groove 21 which is communicated to the water outlet S1 of the main rod 2. A center of the groove 21 is installed with a locking hole 22. A stud P serves to lock the nozzle 3 to the locking hole 22. A fixing hole 23 is formed aside the locking hole 22. A spring 24 and a rolling ball 25 are pre-mounted in the fixing hole 23. The rolling ball 25 slightly protrudes out of the fixing hole 23 for coupling the nozzle 3. When the rolling ball 25 is pressed, the spring is also pressed, so that the nozzle 3 is rotatable.

The second half dome shape joint 3A of the nozzle 3 is protruded with an annular locking seat 31. A periphery of the annular locking seat 31 is formed with an annular recess 34 which is exactly communicated to the water inlet S2 of the nozzle 3. The annular recess S2 is coupled to the groove 21 of the main rod 2 so that water can flow therein. A center of the annular locking seat 31 is formed with a pivotal hole 32 which is coupled to the locking hole 22 of the main rod 2. Thereby, a stud P exactly passes through the pivotal hole 32 and the locking hole 22 for pivotally installing the nozzle 3 to a top of the main rod 2. The annular locking seat 31 of the nozzle 3 has a plurality of limiting holes 33. Thereby, the rolling balls 25 in the fixing hole 23 of the main rod 2 are confined in the limiting holes 33.

Figure 4:
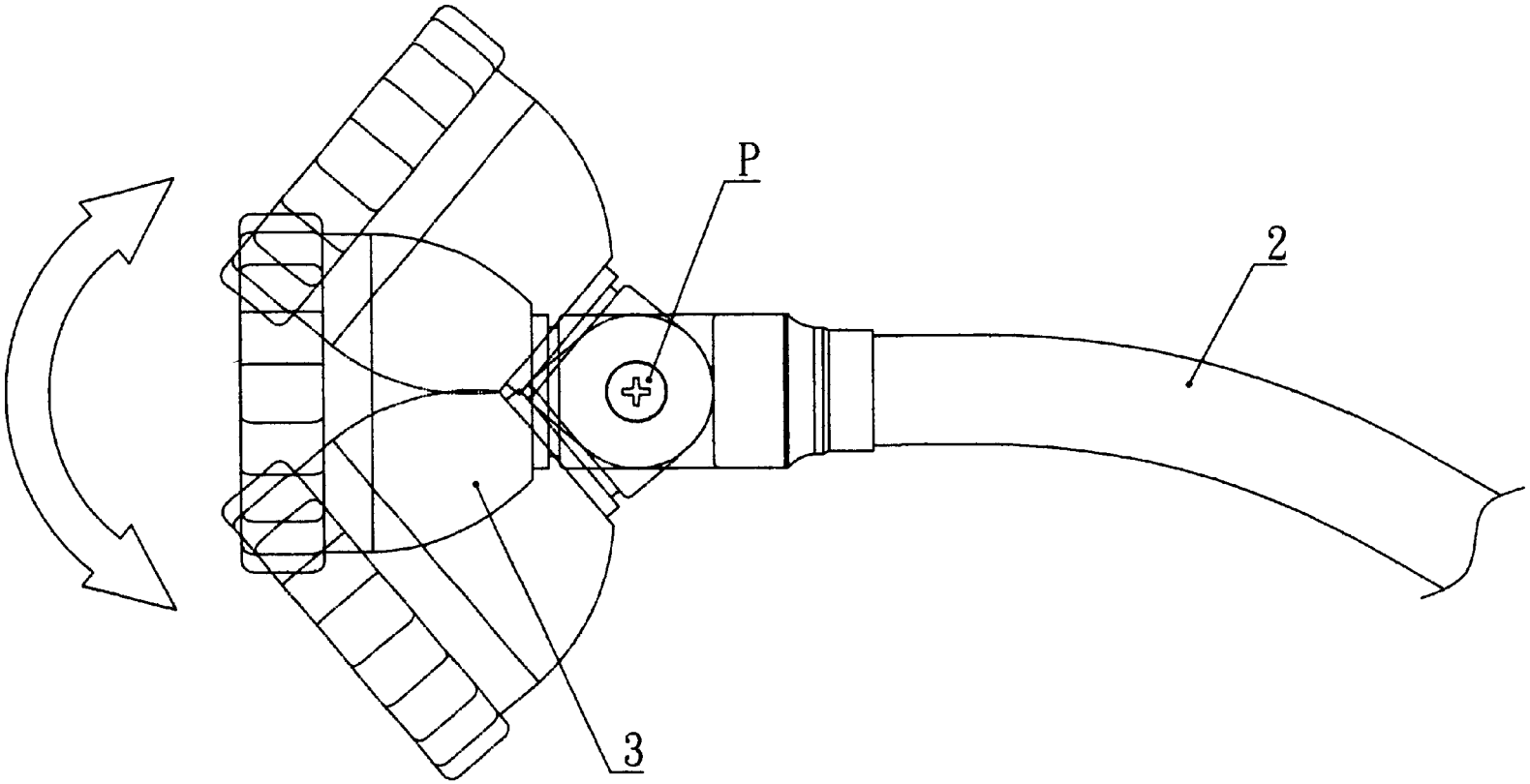
FIG. 4 is a lateral view showing the assembly of the present invention.

The operation of the present invention will be described herein. With reference to FIG. 4, when water flows in the spraying nozzle of the present invention, the water in the, main rod 2 flows out of the water outlet S1 to the groove 21 of the main rod 2. Then the water flows through the limiting holes 33 of the nozzle 3. At a portion of the main rod 2 coupling to the limiting holes 33 has a rolling ball 25 capable of being embedded into the groove 23. When the nozzle 3 rotates, the rolling ball 25 is pressed to resist against the spring 24. Then the rolling ball 25 restores to be embedded to the main rod 2 by the resilient force of the spring 24. Thereby, the ball 25 of the main rod 2 can be coupled to each of the limiting holes 33 of the nozzle 3 so that the nozzle 3 has different orientation to the main rod 2. When it is desired to spray an object at a higher place, the orientation of the nozzle 3 is adjusted for spraying the object.

The present invention is thus described, it will be obvious that the same may be varied in many ways. Such variations are not to be regarded as a departure from the spirit and scope of the present invention, and all such modifications as would be obvious to one skilled in the art are intended to be included within the scope of the following claims.

What is claimed is:

1. A spray nozzle comprising a handle, a main rod extended to an upper side of the handle, a first joint being at a front end of the main rod; the first half joint having a groove which is communicated to a water outlet of the main rod; a center of the groove being formed with a locking hole; a fixing hole being formed aside the locking hole; a spring and a rolling ball being pre-mounted in the fixing hole; the rolling ball slightly protrudes out of the fixing hole for coupling the nozzle; when the rolling ball is pressed, the spring is also pressed, so that the nozzle is rotatable;

a nozzle locked to the locking hole of the main rod by a stud; a second joint of the nozzle being protruded with an annular locking seat; a periphery of the annular locking seat being formed with an annular recess which is exactly communicated to an water inlet of the nozzle; the annular recess being coupled to the groove of the main rod so that water can flow therein; a center of the annular locking seat being formed with a pivotal hole which is coupled to the locking hole of the main rod for pivotally installing the nozzle to a top of the main rod; the annular locking seat of the nozzle having a plurality of limiting holes; thereby, the rolling balls in the fixing hole of the main rod being confined in the limiting holes;

wherein the orientation of the nozzle is adjustable with respect to the main rod.

* * * * *